US011749197B2

(12) United States Patent
Kim

(10) Patent No.: US 11,749,197 B2
(45) Date of Patent: Sep. 5, 2023

(54) ORGANIC LIGHT EMITTING DIODE DISPLAY DEVICE INCLUDING COMPENSATING UNIT AND METHOD DRIVING THE SAME

(71) Applicant: LG Display Co., Ltd., Seoul (KR)

(72) Inventor: Jeong-Hwan Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/991,643

(22) Filed: Nov. 21, 2022

(65) Prior Publication Data

US 2023/0215362 A1 Jul. 6, 2023

(30) Foreign Application Priority Data

Dec. 30, 2021 (KR) ..... 10-2021-0193085

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2320/0209* (2013.01); *G09G 2320/029* (2013.01)

(58) Field of Classification Search
CPC ..... G09G 3/3233; G09G 2300/0819; G09G 2300/0842; G09G 2320/0209; G09G 2320/029
See application file for complete search history.

(56) References Cited

U.S. PATENT DOCUMENTS

| | | | | |
|---|---|---|---|---|
| 9,396,675 | B2 * | 7/2016 | Kim | G09G 3/3225 |
| 9,520,087 | B2 * | 12/2016 | Park | G09G 3/3233 |
| 9,858,864 | B2 * | 1/2018 | Takahiro | G09G 3/3233 |
| 10,366,676 | B2 * | 7/2019 | Kim | G09G 3/3233 |
| 10,706,786 | B2 * | 7/2020 | Jang | G09G 3/3233 |

FOREIGN PATENT DOCUMENTS

KR 10-2015-0017287 A 2/2015

* cited by examiner

*Primary Examiner* — Rodney Amadiz

(74) *Attorney, Agent, or Firm* — Fenwick & West LLP

(57) ABSTRACT

An organic light emitting diode display device includes: a driving transistor; a first transistor switched according to an nth gate voltage and connected to a data voltage and the driving transistor; a second transistor switched according to an nth initialization voltage and connected to an initial voltage and the driving transistor; a third transistor switched according to an nth sensing voltage and connected to a reference voltage and the driving transistor; a fourth transistor switched according to an (n−2)th sensing voltage and connected to the initial voltage and the driving transistor; a storage capacitor connected to the driving transistor and the first transistor; and a light emitting diode connected to a low level voltage and the driving transistor.

9 Claims, 6 Drawing Sheets

FIG. 5

| low level voltage(Vss) | | |
|---|---|---|
| | comparison example | embodiment |
| reference value(Vsr) | 3V | 3V |
| peak value(Vkp) | 2.8802V | 2.9334V |
| peak kickback amount(Vsr-Vkp) | 0.1198V | 0.0666V(44% ▼) |
| recovery value(Vkr) | 2.9685V | 2.9759V |
| recovery kickback amount(Vsr-Vkr) | 0.0315V | 0.0241V(23% ▼) |

ORGANIC LIGHT EMITTING DIODE DISPLAY DEVICE INCLUDING COMPENSATING UNIT AND METHOD DRIVING THE SAME

CROSS REFERENCE TO RELATED APPLICATIONS

The present application claims the priority benefit of Republic of Korea Patent Application No. 10-2021-0193085 filed in Republic of Korea on Dec. 30, 2021, which is hereby incorporated by reference herein in its entirety.

BACKGROUND

Technical Field

The present disclosure relates to an organic light emitting diode display device, and more particularly, to an organic light emitting diode display device including a compensating unit where a kickback amount of a low level voltage is reduced and deterioration such as a crosstalk is prevented by sequentially driving two transistors connected to a source electrode of a driving transistor and a method of driving the organic light emitting diode display device.

Discussion of the Related Art

Recently, with the advent of an information-oriented society and as the interest in information displays for processing and displaying a massive amount of information and the demand for portable information media have increased, a display field has rapidly advanced. Thus, various light and thin flat panel display devices have been developed and highlighted.

Among the various flat panel display devices, an organic light emitting diode (OLED) display device is an emissive type device and does not include a backlight unit used in a non-emissive type device such as a liquid crystal display (LCD) device. As a result, the OLED display device has advantages in a viewing angle, a contrast ratio and a power consumption to be applied to various fields.

In the OLED display device, each subpixel includes a compensating unit of various structures for compensating a threshold voltage of a driving transistor. A compensating unit of a structure of 4T1C where each subpixel includes four transistors and one capacitor has been researched and developed.

In the OLED display device having the compensating unit of a structure of 4T1C, deterioration of a display quality of an image is minimized by compensating a threshold voltage. However, since a voltage of a source electrode of the driving transistor is changed due to a kickback of a low level voltage during an initialization period, deterioration such as a horizontal crosstalk may occur.

SUMMARY

Accordingly, the present disclosure is directed to an organic light emitting diode display device and a method of driving the organic light emitting diode display device that substantially obviate one or more of the problems due to limitations and disadvantages of the related art.

An object of the present disclosure is to provide an organic light emitting diode display device including a compensating unit where a kickback amount of a low level voltage is minimized and deterioration such as a horizontal crosstalk is prevented by changing a voltage of a source electrode of a driving transistor from a start value to a final value through a median value due to two transistors sequentially switched and connected to the source electrode of the driving transistor during an initialization period and a method of driving the organic light emitting diode display device.

Another object of the present disclosure is to provide an organic light emitting diode display device including a compensating unit where a structure of a power unit and a gate driving unit is simplified, deterioration such as a horizontal crosstalk is prevented and a display quality is improved by using an initial voltage applied to a gate electrode of a driving transistor as a median value of a voltage of a source electrode of the driving transistor and driving two transistors connected to the source electrode of the driving transistor with the same kind of gate signal.

Additional features and advantages of the disclosure will be set forth in the description which follows, and in part will be apparent from the description, or may be learned by practice of the disclosure. These and other advantages of the disclosure will be realized and attained by the structure particularly pointed out in the written description and claims hereof as well as the appended drawings.

To achieve these and other advantages and in accordance with the purpose of the present disclosure, as embodied and broadly described herein, an organic light emitting diode display device includes: a driving transistor; a first transistor switched according to an nth gate voltage and connected to a data voltage and the driving transistor; a second transistor switched according to an nth initialization voltage and connected to an initial voltage and the driving transistor; a third transistor switched according to an nth sensing voltage and connected to a reference voltage and the driving transistor; a fourth transistor switched according to an (n−2)th sensing voltage and connected to the initial voltage and the driving transistor; a storage capacitor connected to the driving transistor and the first transistor; and a light emitting diode connected to a low level voltage and the driving transistor.

In another aspect, a method of driving an organic light emitting diode display device including a driving transistor, first to fourth transistors, a storage capacitor and a light emitting diode, includes: during a first time period, turning off the first, second and third transistors, turning on the fourth transistor, and supplying an initial voltage to a source electrode of the driving transistor; during a second time period, turning off the first and fourth transistors, turning on the second and third transistors, and supplying a reference voltage and the initial voltage to the source electrode and a gate electrode, respectively, of the driving transistor; during a third time period, turning off the first, third and fourth transistors, and turning on the second transistor, and supplying the initial voltage to a gate electrode of the driving transistor; and during a fourth time period, turning on the first transistor, turning off the second, third and fourth transistors, and supplying a data voltage to the gate electrode of the driving transistor.

It is to be understood that both the foregoing general description and the following detailed description are explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings:

FIG. 5 is a table showing a kickback amount of an organic light emitting diode display device according to an embodiment of the present disclosure.

DETAILED DESCRIPTION

Figure 1:
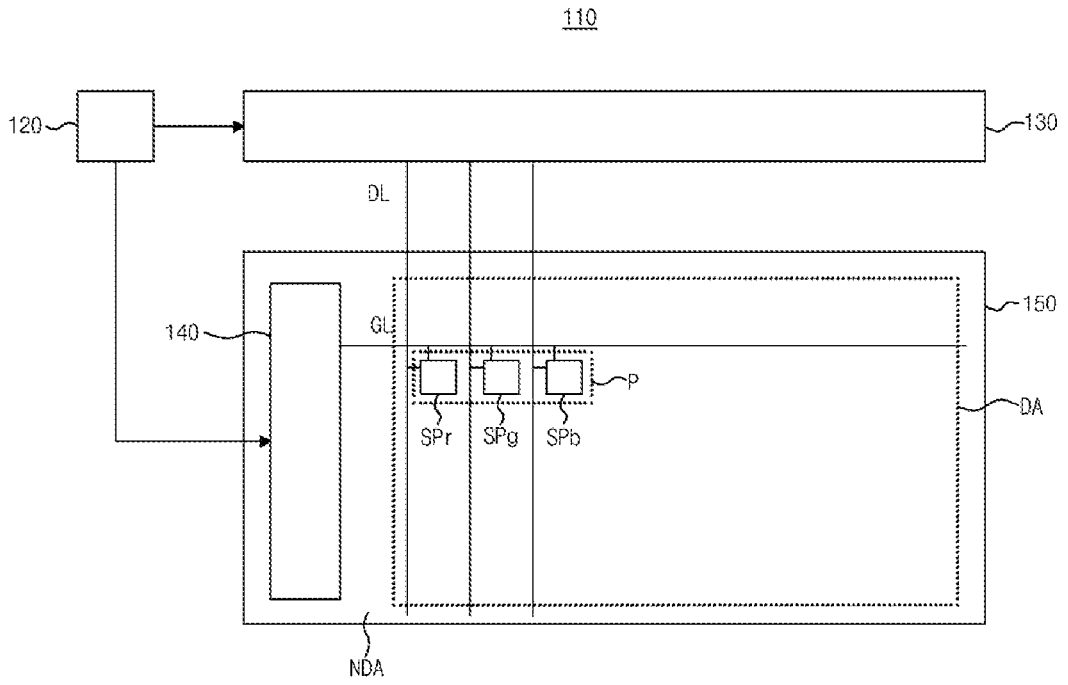
FIG. 1 is a view showing an organic light emitting diode display device according to a first embodiment of the present disclosure.

Advantages and features of the present disclosure, and implementation methods thereof will be clarified through following example embodiments described with reference to the accompanying drawings. The present disclosure may, however, be embodied in different forms and should not be construed as limited to the example embodiments set forth herein. Rather, these example embodiments are provided so that this disclosure may be sufficiently thorough and complete to assist those skilled in the art to fully understand the scope of the present disclosure. Further, the present disclosure is only defined by scopes of claims.

A shape, a size, a ratio, an angle, and a number disclosed in the drawings for describing embodiments of the present disclosure are merely an example. Thus, the present disclosure is not limited to the illustrated details. Like reference numerals refer to like elements throughout. In the following description, when the detailed description of the relevant known function or configuration is determined to unnecessarily obscure an important point of the present disclosure, the detailed description of such known function or configuration may be omitted. In a case where terms "comprise," "have," and "include" described in the present specification are used, another part may be added unless a more limiting term, such as "only," is used. The terms of a singular form may include plural forms unless referred to the contrary.

In construing an element, the element is construed as including an error or tolerance range even where no explicit description of such an error or tolerance range.

In describing a position relationship, when a position relation between two parts is described as, for example, "on," "over," "under," or "next," one or more other parts may be disposed between the two parts unless a more limiting term, such as "just" or "direct(ly)," is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Features of various embodiments of the present disclosure may be partially or overall coupled to or combined with each other, and may be variously inter-operated with each other and driven technically as those skilled in the art can sufficiently understand. Embodiments of the present disclosure may be carried out independently from each other, or may be carried out together in co-dependent relationship.

Hereinafter, an organic light emitting diode display device including a compensating unit according to embodiments of the present disclosure will be described in detail with reference to the accompanying drawings. In the following description, like reference numerals designate like elements throughout. When a detailed description of well-known functions or configurations related to this document is determined to unnecessarily cloud a gist of the inventive concept, the detailed description thereof will be omitted or will be made brief.

FIG. 1 is a view showing an organic light emitting diode display device according to a first embodiment of the present disclosure.

In FIG. 1, an organic light emitting diode (OLED) display device 110 according to an embodiment of the present disclosure includes a timing controlling unit 120, a data driving unit 130, a gate driving unit 140 and a display panel 150.

The timing controlling unit 120 generates an image data, a data control signal and a gate control signal using an image signal and a plurality of timing signals including a data enable signal, a horizontal synchronization signal, a vertical synchronization signal and a clock signal transmitted from an external system such as a graphic card or a television system. The image data and the data control signal are transmitted to the data driving unit 130, and the gate control signal is transmitted to the gate driving unit 140.

The data driving unit 130 generates a data voltage (data signal) using the data control signal and the image data transmitted from the timing controlling unit 120 and transmits the data voltage to a data line DL of the display panel 150.

The gate driving unit 140 generates a gate voltage (gate signal), an initialization voltage (initialization signal) and a sensing voltage (sensing signal) using the gate control signal transmitted from the timing controlling unit 120 and applies the gate voltage, the initialization voltage and the sensing voltage to a gate line GL, an initialization line and a sensing line, respectively, of the display panel 150.

The gate driving unit 140 may have a gate in panel (GIP) type to be formed in a non-display area NDA of a substrate of the display panel 150 having the gate line GL, the data line DL and a pixel P.

The display panel 150 includes a display area DA at a central portion thereof and a non-display area NDA surrounding the display area DA. The display panel 150 displays an image using the gate voltage, the initialization voltage, the sensing voltage and the data voltage. For displaying an image, the display panel 150 includes a plurality of pixels P, a plurality of gate lines GL, a plurality of initialization lines, a plurality of sensing lines and a plurality of data lines DL in the display area DA.

The plurality of initialization lines and the plurality of sensing lines may be separated from and spaced apart from the plurality of gate lines GL.

For example, each of the plurality of pixels P may include red, green and blue subpixels SPr, SPg and SPb, and the gate line GL and the data line DL cross each other to define the red, green and blue subpixels SPr, SPg and SPb. Each of the red, green and blue subpixels SPr, SPg and SPb may be connected to the gate line GL and the data line DL.

A structure and an operation of each subpixel of the display panel 150 of the OLED display device 110 will be illustrated with reference to a drawing.

Figure 2:
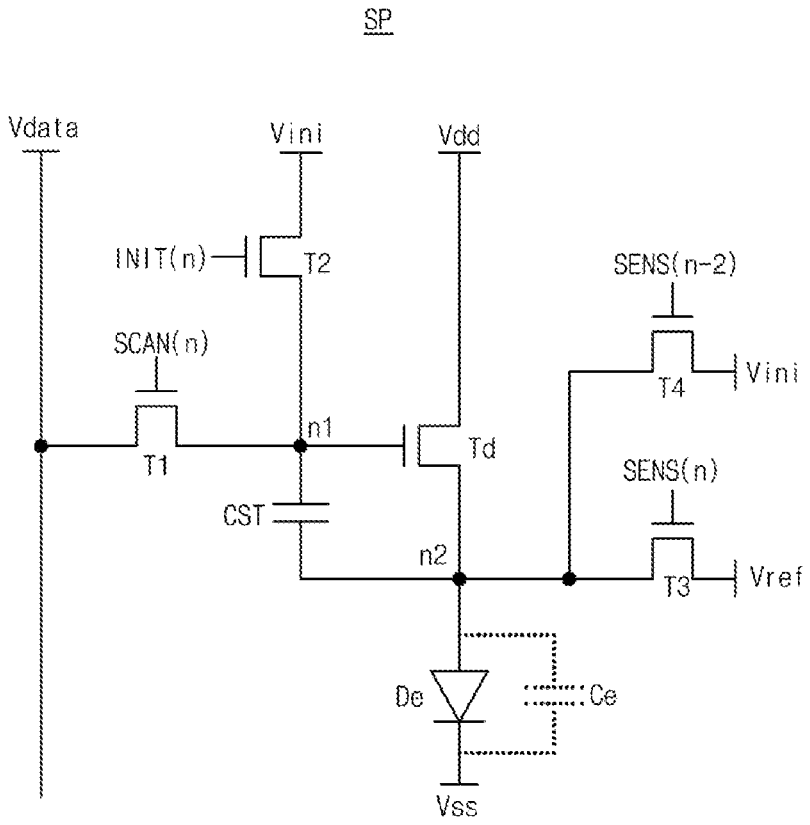
FIG. 2 is a circuit diagram showing a subpixel of an organic light emitting diode display device according to an embodiment of the present disclosure.
Figure 3:
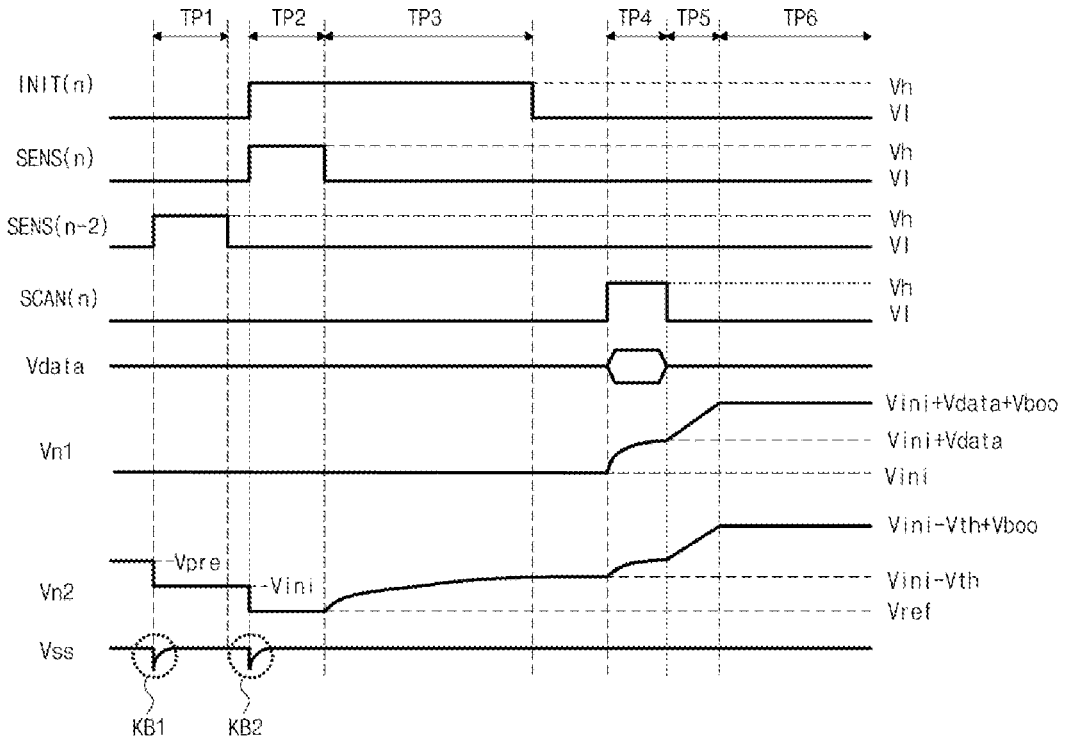
FIG. 3 is a view showing a plurality of signals used in a subpixel of an organic light emitting diode display device according to an embodiment of the present disclosure.

FIG. 2 is a circuit diagram showing a subpixel of an organic light emitting diode display device according to an embodiment of the present disclosure, and FIG. 3 is a view showing a plurality of signals used in a subpixel of an organic light emitting diode display device according to an embodiment of the present disclosure.

In FIG. 2, each of the red, green and blue subpixels SPr, SPg and SPb of the display panel 150 of the OLED display device 110 according to an embodiment of the present disclosure includes a driving transistor Td, first to fourth transistors T1 to T4, a storage capacitor CST and a light emitting diode De.

For example, the driving transistor Td and the first to fourth transistors T1 to T4 may be a polycrystalline silicon thin film transistor of a negative type or an oxide semiconductor thin film transistor of a negative type.

The driving transistor Td is switched (turned on and off) according to a voltage of a first electrode of the storage capacitor CST. A gate electrode of the driving transistor Td is connected to the first electrode of the storage capacitor CST, a source electrode of the first transistor T1 and a source electrode of the second transistor T2, a drain electrode of the driving transistor Td is connected to a high level voltage Vdd, and a source electrode of the driving transistor Td as a second node n2 is connected to a second electrode of the storage capacitor CST, a source electrode of the third transistor T3, a source electrode of the fourth transistor T4 and an anode of the light emitting diode De.

The first transistor T1 of a switching transistor is switched (turned on and off) according to an nth gate voltage SCAN (n). A gate electrode of the first transistor T1 is connected to the nth gate voltage SCAN(n), a drain electrode of the first transistor T1 is connected to a data voltage Vdata, and the source electrode of the first transistor T1 is connected to the gate electrode of the driving transistor Td, the first electrode of the storage capacitor CST and the source electrode of the second transistor T2.

The second transistor T2 of an initialization transistor is switched (turned on and off) according to an nth initialization voltage INIT(n). A gate electrode of the second transistor T2 is connected to the nth initialization voltage INIT(n), a drain electrode of the second transistor T2 is connected to an initial voltage Vini, and the source electrode of the second transistor T2 is connected to the gate electrode of the driving transistor Td, the first electrode of the storage capacitor CST and the source electrode of the first transistor T1.

The third transistor T3 of a sensing transistor is switched (turned on and off) according to an nth sensing voltage SENS(n). A gate electrode of the third transistor T3 is connected to the nth sensing voltage SENS(n), a drain electrode of the third transistor T3 is connected to a reference voltage Vref, and the source electrode of the third transistor T3 is connected to the source electrode of the driving transistor Td, the second electrode of the storage capacitor CST and a source electrode of the fourth transistor T4.

The fourth transistor T4 of a sensing transistor is switched (turned on and off) according to an (n−2)th sensing voltage SENS(n−2). A gate electrode of the fourth transistor T4 is connected to the (n−2)th sensing voltage SENS(n−2), a drain electrode of the fourth transistor T4 is connected to the initial voltage Vini, the source electrode of the fourth transistor T4 is connected to the source electrode of the driving transistor Td, the second electrode of the storage capacitor CST, the source electrode of the third transistor T3 and the anode of the light emitting diode De.

The storage capacitor CST stores a threshold voltage Vth. The first electrode of the storage capacitor CST is connected to the gate electrode of the driving transistor Td, the source electrode of the first transistor T1 and the source electrode of the second transistor T2, and the second electrode of the storage capacitor CST is connected to the source electrode of the driving transistor Td, the source electrode of the third transistor T3, the source electrode of the fourth transistor T4 and the anode of the light emitting diode De.

The light emitting diode De is connected between the driving transistor Td and the low level voltage Vss and emits a light of a luminance proportional to a current of the driving transistor Td. The anode of the light emitting diode De is connected to the source electrode of the driving transistor Td, the second electrode of the storage capacitor CST, the source electrode of the third transistor T3 and the source electrode of the fourth transistor T4, and a cathode of the light emitting diode De is connected to the low level voltage Vss.

The gate electrode of the driving transistor Td, the first electrode of the storage capacitor CST, the source electrode of the first transistor T1 and the source electrode of the second transistor T2 are connected to each other to constitute a first node n1, and the source electrode of the driving transistor Td, the second electrode of the storage capacitor CST, the source electrode of the third transistor T3 and the source electrode of the fourth transistor T4 are connected to each other to constitute the second node n2.

The initial voltage Vini may be higher than the reference voltage Vref.

The (n−2)th sensing voltage SENS(n−2) may be a voltage used in an (n−2)th horizontal pixel line two rows prior to an nth horizontal pixel line where the nth sensing voltage SENS(n) is used.

In FIG. 3, each subpixel SP of the OLED display device 110 according to an embodiment of the present disclosure emits a light by frames, and one frame of a minimum unit includes first to sixth time periods TP1 to TP6.

During the first time period TP1 of an initialization period, the nth initialization voltage INIT(n), the nth sensing voltage SENS(n) and the nth gate voltage SCAN(n) become a low logic voltage V1, and the (n−2)th sensing voltage SENS(n−2) becomes a high logic voltage Vh. The first, second and third transistors T1, T2 and T3 are turned off, and the fourth transistor T4 is turned on. As a result, a second node voltage Vn2 of the second node n2 becomes the initial voltage Vini such that the source electrode of the driving transistor Td is firstly initialized.

For example, the first time period TP1 may correspond to about 1.5 horizontal period (1.5H).

During the second time period TP2 of an initialization period, the nth initialization voltage INIT(n) and the nth sensing voltage SENS(n) become a high logic voltage Vh, and the (n−2)th sensing voltage SENS(n−2) and the nth gate voltage SCAN(n) become a low logic voltage V1. The first and fourth transistors T1 and T4 are turned off, and the second and third transistors T2 and T3 are turned on. As a result, a first node voltage Vn1 of the first node n1 becomes the initial voltage Vini such that the gate voltage of the driving transistor Td is initialized, and the second node voltage Vn2 of the second node n2 becomes the reference voltage Vref such that the source electrode of the driving transistor Td is secondly initialized.

For example, the second time period TP2 may correspond to about 1.5 horizontal period (1.5H).

During the third time period TP3 of a sensing period, the nth initialization voltage INIT(n) becomes a high logic voltage Vh, and the nth sensing voltage SENS(n), the (n−2)th sensing voltage SENS(n−2) and the nth gate voltage SCAN(n) become a low logic voltage V1. The first, third and fourth transistors T1, T3 and T4 are turned off, and the second transistor T2 is turned on. As a result, the first node voltage Vn1 of the first node n1 is maintained as the initial voltage Vini, and the second node voltage Vn2 of the second node n2 becomes a value (Vini−Vth) obtained by subtracting the threshold voltage Vth of the driving transistor Td from the initial voltage Vini such that the threshold voltage Vth is stored in the storage capacitor CST.

For example, the third time period TP3 may be about 200 μs.

During the fourth time period TP4 of a writing period, the nth initialization voltage INIT(n), the nth sensing voltage SENS(n) and the (n−2)th sensing voltage SENS(n−2) become a low logic voltage V1, and the nth gate voltage SCAN(n) becomes a high logic voltage Vh. The first transistor T1 is turned on, and the second, third and fourth transistors T2, T3 and T4 are turned off. As a result, the first node voltage Vn1 of the first node n1 becomes a value (Vini+Vdata) obtained by adding the data voltage Vdata to the initial voltage Vini, and the second node voltage Vn2 of the second node n2 is maintained as the value (Vini−Vth) obtained by subtracting the threshold voltage Vth of the driving transistor Td from the initial voltage Vini such that the data voltage Vdata is written to the gate electrode of the driving transistor Td.

During a period between the third and fourth time periods TP3 and TP4, the first, second, third and fourth transistors T1, T2, T3 and T4 are turned off, and the gate electrode and the source electrode of the driving transistor Td are electrically floated. For example, the period between the third and fourth time periods TP3 and TP4 may correspond to about 0.7 horizontal period (0.7H).

During the fifth time period TP5 of a boosting period, the nth initialization voltage INIT(n), the nth sensing voltage SENS(n), the (n−2)th sensing voltage SENS(n−2) and the nth gate voltage SCAN(n) become a low logic voltage V1. The first, second, third and fourth transistors T1, T2, T3 and T4 are turned off. As a result, the first node voltage Vn1 of the first node n1 gradually increases through the storage capacitor CST to become a value (Vini+Vdata+Vboo) obtained by adding a boosting voltage Vboo to a sum of the initial voltage Vini and the data voltage Vdata, and the second node voltage Vn2 of the second node n2 gradually increases through the driving transistor Td turned on to become a value (Vini−Vth+Vboo) obtained by adding the boosting voltage Vboo to the difference between the initial voltage Vini and the threshold voltage Vth such that the anode of the light emitting diode De is charged. During the fifth time period TP5, a high level voltage is supplied to the light emitting diode De to increase a voltage of the anode of the light emitting diode De.

During the sixth time period TP6 of an emission period, the nth initialization voltage INIT(n), the nth sensing voltage SENS(n), the (n−2)th sensing voltage SENS(n−2) and the nth gate voltage SCAN(n) become a low logic voltage V1. The first, second, third and fourth transistors T1, T2, T3 and T4 are turned off. As a result, a current proportional to a square of a value (Vdata) obtained by subtracting the threshold voltage Vth from a gate-source voltage (Vgs=(Vg−Vs)=(Vini+Vdata+Vboo)−(Vini−Vth+Vboo)=Vdata+Vth) flows through the driving transistor Td, and the second node voltage Vn2 of the second node n2 becomes higher than a threshold voltage of the light emitting diode De such that the light emitting diode De emits a light of a luminance corresponding to the current flowing through the driving transistor Td. During the sixth time period TP6, the high level voltage is supplied to the light emitting diode De to emit a light.

The second node voltage Vn2 of the second node n2 is maintained as a previous voltage Vpre corresponding to the data voltage Vdata of a previous frame before the first time period TP1. Further, the second node voltage Vn2 of the second node n2 is changed to the initial voltage Vini during the first time period TP1 and is changed to the reference voltage Vref during the second time period TP2.

For example, the previous voltage Vpre may be higher than the initial voltage Vini and the reference voltage Vref, and the initial voltage Vini may be lower than the previous voltage Vpre and higher than the reference voltage Vref. The initial voltage Vini may be between the previous voltage Vpre and the reference voltage Vref.

Since the light emitting diode De is equivalent to a light emitting capacitor Ce, the low level voltage Vss is changed according to a change of the second node voltage Vn2 of the second node n2. As a result, a first kickback KB1 of the low level voltage Vss is generated at a start timing of the first time period TP1 corresponding to a change timing of the second node voltage Vn2, and a second kickback KB2 of the low level voltage Vss is generated at a start timing of the second time period TP2 corresponding to a change timing of the second node voltage Vn2.

A drop of the low level voltage Vss is generated due to the first and second kickbacks KB1 and KB2 and may be expressed by following equations.

$$V(\mathrm{KB1})=(\mathrm{Ce}/\mathrm{Ce}+Cst)*(V\mathrm{pre}-V\mathrm{ini})$$

$$V(\mathrm{KB2})=(\mathrm{Ce}/\mathrm{Ce}+Cst)*(V\mathrm{ini}-V\mathrm{ref})$$

The drop of the low level voltage Vss decreases the second node voltage Vn2 due to a coupling through the light emitting capacitor Ce during the sensing period of each subpixel SP of the previous horizontal pixel line. As a result, the gate-source voltage Vgs increases and the luminance of the light emitted from the light emitting diode De increases to cause deterioration such as a crosstalk.

When the second node voltage Vn2 decreases directly from the previous voltage Vpre to the reference voltage Vref at one time, a drop of the low level voltage Vss due to a kickback may be expressed by a following equation.

$$V(\mathrm{KB})=(\mathrm{Ce}/\mathrm{Ce}+Cst)*(V\mathrm{pre}-V\mathrm{ref})$$

In the OLED display device 110 according to an embodiment of the present disclosure, the second node voltage Vn2 firstly decreases from the previous voltage Vpre to the initial voltage Vini of a median value and secondly decreases from the initial voltage Vini to the reference voltage Vref of a final value. As a result, the voltage drop amount of the first and second kickbacks KB1 and KB2 is reduced as compared with the voltage drop amount of the kickback KB (V(KB1)<V(KB), V(KB2)<V(KB)). In addition, a decrease of the second node voltage Vn2 and an increase of the gate-source voltage Vgs of each subpixel SP of the previous horizontal pixel line are minimized, and deterioration such as a crosstalk is prevented.

The voltage drop amount of the kickback will be illustrated with reference to drawings.

Figure 4A:
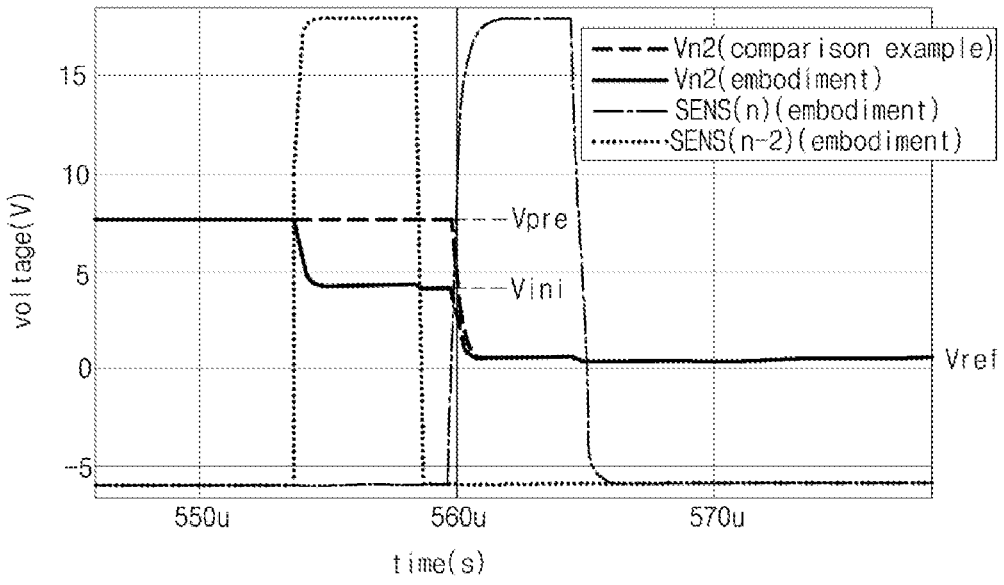
FIG. 4A is a view showing a second node voltage of a subpixel of an organic light emitting diode display device according to an embodiment of the present disclosure.
Figure 4B:
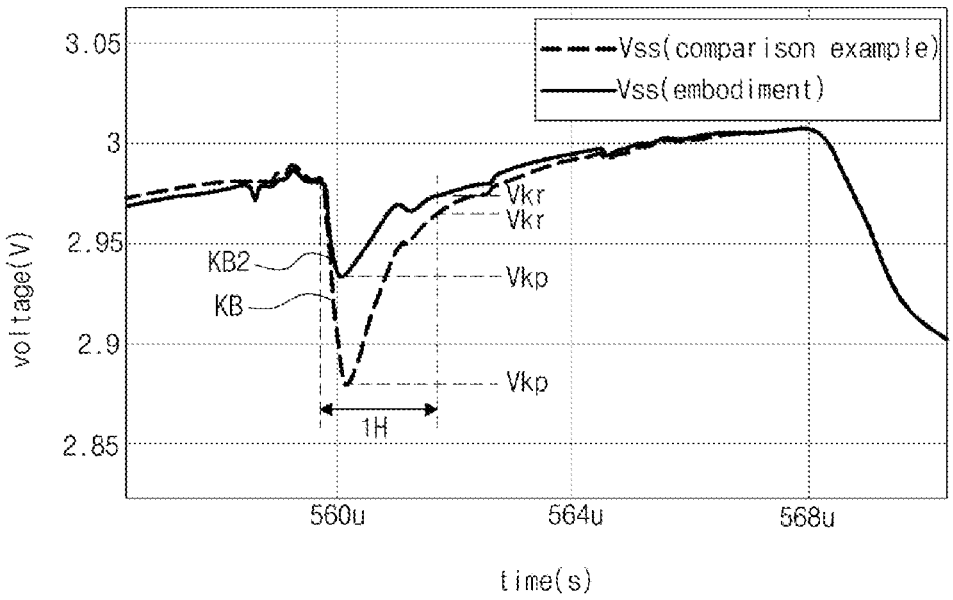
FIG. 4B is a view showing a low level voltage of an organic light emitting diode display device according to an embodiment of the present disclosure.

FIG. 4A is a view showing a second node voltage of a subpixel of an organic light emitting diode display device according to an embodiment of the present disclosure, FIG. 4B is a view showing a low level voltage of an organic light emitting diode display device according to an embodiment of the present disclosure, and FIG. 5 is a table showing a kickback amount of an organic light emitting diode display device according to an embodiment of the present disclosure.

In an OLED display device according to a comparison example of FIG. 4A, the second node voltage Vn2 decreases directly from the previous voltage Vpre to the reference voltage Vref at a rising timing of the nth sensing voltage SENS(n).

In the OLED display device 110 according to an embodiment of the present disclosure of FIG. 4A, the second node voltage Vn2 decreases from the previous voltage Vpre to the initial voltage Vini of a median value at a rising timing of the (n−2)th sensing voltage SENS(n−2), and the second node voltage Vn2 decreases from the initial voltage Vini to the reference voltage Vref of a final value at a rising timing of the nth sensing voltage SENS(n).

In the OLED display device 110 according to an embodiment of the present disclosure, the second node voltage Vn2 sequentially and divisionally decreases from the previous voltage Vpre to the reference voltage Vref of a final value through the initial voltage Vini of a median value.

In FIG. 4B, a voltage drop amount of the second kickback KB2 of the low level voltage Vss of the OLED display device 110 according to an embodiment of the present disclosure is smaller than a voltage drop amount of the kickback KB of the low level voltage Vss of the OLED display device according to a comparison example.

For example, in FIG. 5, when the reference value Vsr of the low level voltage Vss is about 3V, a peak value Vkp of the low level voltage Vss of the kickback KB of a comparison example may be about 2.8802V, and a peak kickback amount (Vsr−Vkp) of the voltage drop amount of the low level voltage Vss of the kickback KB of a comparison example may be about 0.1198V. In addition, when the reference value Vsr of the low level voltage Vss is about 3V, a peak value Vkp of the low level voltage Vss of the second kickback KB2 of an embodiment may be about 2.9334V, and a peak kickback amount (Vsr−Vkp) of the voltage drop amount of the low level voltage Vss of the second kickback KB2 of an embodiment may be about 0.0666V.

The peak kickback amount (Vsr−Vkp) of an embodiment of the present disclosure is reduced by about 44% as compared with the peak kickback amount (Vsr−Vkp) of a comparison example.

When the reference value Vsr of the low level voltage Vss is about 3V, a recovery value Vkr of the low level voltage Vss after one horizontal period (1H) of the kickback KB of a comparison example may be about 2.9685V, and a recovery kickback amount (Vsr−Vkr) of the voltage drop amount of the low level voltage Vss after one horizontal period (1H) of the kickback KB of a comparison example may be about 0.0315V. In addition, when the reference value Vsr of the low level voltage Vss is about 3V, a recovery value Vkr of the low level voltage Vss after one horizontal period (1H) of the second kickback KB2 of an embodiment may be about 2.9759V, and a recovery kickback amount (Vsr−Vkr) of the voltage drop amount of the low level voltage Vss after one horizontal period (1H) of the second kickback KB2 of an embodiment may be about 0.0241V.

Since the recovery kickback amount (Vsr−Vkr) of an embodiment of the present disclosure is reduced by about 23% as compared with the recovery kickback amount (Vsr−Vkr) of a comparison example, a recovery time of the low level voltage Vss of an embodiment of the present disclosure is reduced as compared with a recovery time of the low level voltage Vss of a comparison example.

Further, the first kickback KB1 may have a peak value Vkp, a peak kickback amount (Vsr−Vkp), a recovery value Vkr and a recovery kickback amount (Vsr−Vkr) of the low level voltage Vss similar to the second kickback KB2.

Consequently, in the OLED display device 110 according to an embodiment of the present disclosure, the voltage of the source electrode of the driving transistor Td is changed from the previous voltage Vpre of a start value to the initial voltage Vini of a median value during the first time period TP1 of a first initialization period, and is changed from the initial voltage Vini of a median value to the reference voltage Vref of a final value during the second time period TP2 of a second initialization period TP2. As a result, the peak kickback amount (Vsr−Vkp) and the recovery kickback amount (Vsr−Vkr) of the first and second kickbacks KB1 and KB2 are minimized, and a decrease of the second node voltage Vn2 and an increase of the gate-source voltage Vgs of each subpixel SP of the previous horizontal pixel line are minimized. Accordingly, deterioration such as a crosstalk is prevented.

Further, the initial voltage Vini for initialization of the gate electrode of the driving transistor Td is applied to the source electrode of the driving transistor Td through the fourth transistor T4 to be used as a median value of the second node voltage Vn2. As a result, an increase of a number of required source voltages is prevented, and a power unit is simplified.

In addition, since the third and fourth transistors T3 and T4 connected to the source electrode of the driving transistor Td are switched according to the nth and (n−2)th sensing voltages SENS(n) and SENS(n−2) the same kind as each other, an increase of a number of required gate signals is prevented and the gate driving unit 140 is simplified.

It will be apparent to those skilled in the art that various modifications and variation can be made in the present disclosure without departing from the scope of the disclosure. Thus, it is intended that the present disclosure cover the modifications and variations of this disclosure provided they come within the scope of the appended claims.

What is claimed is:

1. An organic light emitting diode display device, comprising:

a driving transistor;

a first transistor switched according to an nth gate voltage and connected to a data voltage and the driving transistor;

a second transistor switched according to an nth initialization voltage and connected to an initial voltage and the driving transistor;

a third transistor switched according to an nth sensing voltage and connected to a reference voltage and the driving transistor;

a fourth transistor switched according to an (n−2)th sensing voltage and connected to the initial voltage and the driving transistor;

a storage capacitor connected to the driving transistor and the first transistor; and a light emitting diode connected to a low level voltage and the driving transistor.

2. The organic light emitting diode display device of claim 1, wherein the driving transistor and the first to fourth transistors are one of a polycrystalline silicon thin film transistor of a negative type and an oxide semiconductor thin film transistor of a negative type.

3. The organic light emitting diode display device of claim 1, wherein a gate electrode of the driving transistor is connected to a first electrode of the storage capacitor, a source electrode of the first transistor and a source electrode of the second transistor, wherein a drain electrode of the driving transistor is connected to a high level voltage, wherein a source electrode of the driving transistor is connected to a second electrode of the storage capacitor, a source electrode of the third transistor, a source electrode of the fourth transistor and an anode of the light emitting diode, wherein a gate electrode of the first transistor is connected to the nth gate voltage, a drain electrode of the first transistor is connected to the data voltage, and the source electrode of the first transistor is connected to the gate electrode of the driving transistor, the first electrode of the storage capacitor and the source electrode of the second transistor, wherein a gate electrode of the second transistor is connected to the nth initialization voltage, a drain electrode of the second transistor is connected to the initial voltage, and the source electrode of the second transistor is connected to the gate electrode of the driving transistor, the first electrode of the storage capacitor and the source electrode of the first transistor, wherein a gate electrode of the third transistor is connected to the nth sensing voltage, a drain electrode of the third transistor is connected to a reference voltage, and the source electrode of the third transistor is connected to the source electrode of the driving transistor, the second electrode of the storage capacitor and a source electrode of the fourth transistor, wherein a gate electrode of the fourth transistor is connected to the (n−2)th sensing voltage, a drain electrode of the fourth transistor is connected to the initial voltage, the source electrode of the fourth transistor is connected to the source electrode of the driving transistor, the second electrode of the storage capacitor, the source electrode of the third transistor and the anode of the light emitting diode, wherein the first electrode of the storage capacitor is connected to the gate electrode of the driving transistor, the source electrode of the first transistor and the source electrode of the second transistor, wherein the second electrode of the storage capacitor is connected to the source electrode of the driving transistor, the source electrode of the third transistor, the source electrode of the fourth transistor and the anode of the light emitting diode, wherein the anode of the light emitting diode is connected to the source electrode of the driving transistor, the second electrode of the storage capacitor, the source electrode of the third transistor and the source electrode of the fourth transistor, and wherein a cathode of the light emitting diode is connected to the low level voltage.

4. The organic light emitting diode display device of claim 1, wherein a frame for displaying an image includes first to fourth time periods, wherein during the first time period, the nth initialization voltage, the nth sensing voltage and the nth gate voltage have a low logic voltage, and the (n−2)th sensing voltage has a high logic voltage, wherein during the second time period, the nth initialization voltage and the nth sensing voltage have the high logic voltage, and the (n−2)th sensing voltage and the nth gate voltage have the low logic voltage, wherein during the third time period, the nth initialization voltage has the high logic voltage, and the nth sensing voltage, the (n−2)th sensing voltage and the nth gate voltage have the low logic voltage, and wherein during the fourth time period, the nth initialization voltage, the nth sensing voltage and the (n−2)th sensing voltage have the low logic voltage, and the nth gate voltage has the high logic voltage.

5. The organic light emitting diode display device of claim 4, wherein the source electrode of the driving transistor has a previous voltage before the first time period, wherein the source electrode of the driving transistor has the initial voltage during the first time period, wherein the source electrode of the driving transistor has the reference voltage during the second time period, and wherein the initial voltage has a value between the previous voltage and the reference voltage.

6. The organic light emitting diode display device of claim 4, wherein the frame further includes fifth and sixth time periods, wherein during the fifth and sixth time periods, the nth initialization voltage, the nth sensing voltage, the (n−2) th sensing voltage and the nth gate voltage have a low logic voltage.

7. The organic light emitting diode display device of claim 6, wherein during the second time period, the gate electrode of the driving transistor has the initial voltage, and the source electrode of the driving transistor has the reference voltage, wherein during the third time period, the gate electrode of the driving transistor has the initial voltage, and the source electrode of the driving transistor has a value obtained by subtracting a threshold voltage of the driving transistor from the initial voltage, wherein during the fourth time period, the gate electrode of the driving transistor has a value obtained by adding the data voltage to the initial voltage, and the source electrode of the driving transistor has a value obtained by subtracting the threshold voltage from the initial voltage, and wherein during the fifth time period, the gate electrode of the driving transistor has a value obtained by adding a boosting voltage to a sum of the initial voltage and the data voltage, and the source electrode of the driving transistor has a value obtained by adding the boosting voltage to a difference between the initial voltage and the threshold voltage.

8. A method of driving an organic light emitting diode display device including a driving transistor, first to fourth transistors, a storage capacitor and a light emitting diode, comprising:

during a first time period, turning off the first, second and third transistors, turning on the fourth transistor, and supplying an initial voltage to a source electrode of the driving transistor;

during a second time period, turning off the first and fourth transistors, turning on the second and third transistors, and supplying a reference voltage and the initial voltage to the source electrode and a gate electrode, respectively, of the driving transistor;

during a third time period, turning off the first, third and fourth transistors, and turning on the second transistor, and supplying the initial voltage to the gate electrode of the driving transistor; and during a fourth time period, turning on the first transistor, turning off the second, third and fourth transistors, and supplying a data voltage to the gate electrode of the driving transistor.

9. The method of claim 8, further comprising:

during a fifth time period, turning off the first, second, third and fourth transistors, and supplying a high level voltage to the light emitting diode to increase a voltage of an anode of the light emitting diode, and during a sixth time period, turning off the first, second, third and fourth transistors, and supplying the high level voltage to the light emitting diode to emit a light.

* * * * *